US006073770A

United States Patent [19]

Park

[11] Patent Number: 6,073,770

[45] Date of Patent: Jun. 13, 2000

[54] BRIEFCASE HAVING SHOCK-ABSORBING FUNCTION

[76] Inventor: Sang Jun Park, Kyoungki-do, 435-010, Rep. of Korea

[21] Appl. No.: 09/170,403

[22] Filed: Oct. 13, 1998

[30] Foreign Application Priority Data

Dec. 17, 1997 [KR] Rep. of Korea ..... 97-70217
Apr. 29, 1998 [KR] Rep. of Korea ..... 98-6870

[51] Int. Cl.[7] ..... B65D 81/02

[52] U.S. Cl. ..... 206/522; 206/320; 206/523; 206/586

[58] Field of Search ..... 206/522, 523, 206/586, 591, 592, 594, 576, 320, 305; 383/3

[56] References Cited

U.S. PATENT DOCUMENTS

| | | | |
|---|---|---|---|
| 4,573,202 | 2/1986 | Lee | 206/522 |
| 4,801,213 | 1/1989 | Frey et al. | 206/522 |
| 5,184,727 | 2/1993 | Dickie et al. | 206/522 |
| 5,351,829 | 10/1994 | Batsford | 206/522 |
| 5,755,329 | 5/1998 | Sadow | 206/522 |
| 5,862,914 | 1/1999 | Farison et al. | 206/522 |
| 5,884,768 | 3/1999 | Fox | 206/522 |

*Primary Examiner*—Paul T. Sewell
*Assistant Examiner*—Luan K. Bui
*Attorney, Agent, or Firm*—Quarles & Brady LLP

[57] ABSTRACT

A briefcase having shock-absorbing functions includes a plurality of shock-absorbing air pads 70 each of which comprises an inner skin 76 and an outer skin 78. A pair of foaming elements 82 are intervened between the inner skin 76 and the outer skin 78 such that they are spaced apart by a distance. The pair of foaming elements 82 define a first shock-absorbing section 72 and a second shock-absorbing section 74 in the shock-absorbing air pad 70. The first shock-absorbing section 72 and the second shock-absorbing section 74 are filled with an air of a predetermined pressure, and the first shock-absorbing section 72 and the second shock-absorbing section 74 are connected to each other by a connection part 84 which is composed only of the inner skin 76 and the outer skin 78. An air passage 86 is defined in the connection part 84 for communicating the first shock-absorbing section 72 and the second shock-absorbing section 74 which are filled with the air.

11 Claims, 7 Drawing Sheets

BRIEFCASE HAVING SHOCK-ABSORBING FUNCTION

BACKGROUND OF THE INVENTION

1. Field of the Invention

The present invention relates to a shock-absorbable briefcase, and more particularly to a briefcase having shock-absorbing function, which can sequentially absorb and/or alleviate an impact force applied to it thereby to effectively protect an article received therein.

2. Description of the Related Art

Conventionally, a briefcase is utilized to display its role of general receiving function for receiving and holding various articles. In case that the briefcase accommodates a costly article such as notebook computer, specific shock-absorbing means capable of protecting the article from shock must be provided to the briefcase.

Referring to FIG. 1, there is illustrated a perspective view of a briefcase having shock-absorbing function of the related art, and FIG. 2 illustrates a partially cut-away perspective view showing an independent appearance of a shock-absorbing air pad used in the briefcase of FIG. 1. A briefcase having shock-absorbing function of the related art includes a body 1 for receiving and holding an article 7, and a cover 2 pivotally connected to the body 1 for preventing the article 7 received in the body 1 from being released. The body 1 and the cover 2 cooperate with each other to define an article receiving space. The body 1 and the cover 2 are provided with two pairs of opening/closing means 3 such as latch/striker mechanism, respectively, which allow the article receiving space to be opened and closed. Each of the body 1 and the cover 2 has a bottom wall 11 which delimits lower and upper ends of the article receiving space and a side wall 12 which delimits front, rear, left and right ends of the article receiving space. Each of the bottom wall 11 and the side wall 12 comprises an inner shell 4 and an outer shell 5 between which a foaming member 6 is intervened for allowing the briefcase to retain its desired rigidity. The inner shell 4 and the outer shell 5 are integrally coupled to each other by sewing means. At a center portion of the body 1, there is disposed an elastic band 8 for holding the article 7 such as notebook computer in position when the article 7 is received in the article receiving space.

The briefcase having shock-absorbing function of the related art further includes a shock-absorbing air pad 9. The shock-absorbing air pad 9 is fitted into the article receiving space such that it is close contacted with an inner surface of the side wall 12 of the body 1. A foaming element 10 is inserted into the shock-absorbing air pad 9, and an air of a predetermined pressure is filled into the shock-absorbing air pad 9. The shock-absorbing air pad 9 functions to surround front, rear, left and right surfaces of the costly article 7 such as notebook computer received in the body 1 thereby to absorb and/or alleviate an impact force applied to the article 7.

However, the briefcase of the related art, constructed as mentioned above, still suffers from defects in that since the shock-absorbing air pad 9 comprises a single integral segment which extends lengthwise to completely surround the front, rear, left and right surfaces of the article 7, it cannot be used to another briefcase having a different size, especially a smaller size. Namely, if the shock-absorbing air pad 9 is used in a briefcase of a smaller size, because portions of the shock-absorbing air pad 9 are overlapped with each other, a volume of the article receiving space is reduced whereby the article 7 cannot be properly received in the article receiving space. Also, since the shock-absorbing air pad 9 does not include any bent portions, an operation for fitting the shock-absorbing air pad 9 into a corner portion of the side wall 12 of the body 1 is much involved and time-consuming. Further, since the briefcase having shock-absorbing function of the related art is so constructed as to absorb only the impact force applied to the side wall 12 of body 1 and/or cover 2, if an impact force is applied to the bottom wall 11 of the body 1 and/or cover 2, the impact force is directly transferred to the article 7 whereby the article 7 may be apt to be broken.

SUMMARY OF THE INVENTION

Accordingly, the present invention has been made in an effort to solve the problems occurring in the prior art, and a primary object of the present invention is to provide a briefcase having shock-absorbing function, which can sequentially absorb and/or alleviate an impact force applied to it thereby to effectively protect an article received therein.

Another object of the present invention is to provide a shock-absorbing air pad which can protect a costly article from shock irrespective of a size of a briefcase and which can easily and quickly be detached from the briefcase to afford simple receiving function to the briefcase.

Still another object of the present invention is to provide a briefcase having shock-absorbing function, the briefcase including air supplying means which can define a shock-absorbable air layer in a bottom wall and a side wall composing a body and a cover of the briefcase.

According to one aspect of the present invention, there is provided a briefcase for receiving an article comprising: a body and a cover each having a bottom wall and a side wall; and a plurality of air pads each being detachably attached to a corner portion of the side wall of the body and/or cover for absorbing an impact force applied to the side wall.

According to another aspect of the present invention, each air pad comprises an air-impermeable outer skin detachably attached to the side wall and an air-impermeable inner skin integrally coupled to the outer skin, and wherein a pair of foaming elements are intervened between the outer skin and the inner skin such that they are spaced apart by a distance thereby to define a first shock-absorbing section and a second shock-absorbing section at both sides of the corner portion, respectively, the first and second shock-absorbing sections being connected to each other by a connection part in which an air passage is formed to communicate the first and second shock-absorbing sections with each other.

According to another aspect of the present invention, the foaming element is bonded to the outer skin and the inner skin by an adhesive.

According to another aspect of the present invention, each foaming element comprises a first foaming piece having a ductility for primarily absorbing the impact force applied to the side wall, a second foaming piece stacked onto the first foaming piece and having a rigidity larger than that of the first foaming piece for secondarily absorbing a portion of the impact force not absorbed by the first foaming piece, and a third foaming piece stacked onto the second foaming piece and having another rigidity larger than that of the second foaming piece for thirdly absorbing another portion of the impact force not absorbed by the second foaming piece.

According to another aspect of the present invention, an upper surface and a lower surface of each foaming element are formed with a plurality of grooves, respectively, into which an air of a predetermined pressure is filled so that the impact force applied to the side wall is sequentially absorbed by the foaming element and the air filled into the plurality of grooves.

According to another aspect of the present invention, each of the bottom wall and the side wall comprises an outer shell and an inner shell, and wherein the briefcase further comprises first air supplying means for supplying air between the outer shell and the inner shell thereby defining a first air layer between the outer shell and the inner shell.

According to another aspect of the present invention, the briefcase further comprises second air supplying means for supplying air between the outer skin and the inner skin of the air pad thereby defining a second air layer between the outer skin and the inner skin.

According to another aspect of the present invention, each of the first and second air supplying means comprises a pump and a check valve, whereby air pressures in the first and second air layers can be adjusted as occasion calls.

According to still another aspect of the present invention, the outer skin and the inner skin composing the air pad are made from urethane, and the outer shell and the inner shell composing the bottom wall and side wall are made from a combination of cloth and urethane.

According to yet still another aspect of the present invention, edges of the outer skin and the inner skin composing the air pad, and edges of the outer shell and the inner shell composing the bottom wall and side wall are fused to each other, respectively, by an ultrasonic wave to prevent air from leaking.

By the features of the present invention, it is possible to sequentially absorb and/or alleviate an impact force applied from outside and to protect an article received in the briefcase from shock. Also, by the fact that a plurality of shock-absorbing air pads can be selectively and detachably mounted to the briefcase, the briefcase may selectively display its role of general receiving function for receiving and holding various articles such as documents, clothes, etc. or its role of shock-absorbing function for absorbing the impact force to protect the costly article such as notebook computer, whereby a functionality of the briefcase is maximized.

BRIEF DESCRIPTION OF THE DRAWINGS

The above objects, and other features and advantages of the present invention will become more apparent after a reading of the following detailed description taken in conjunction with the drawings, in which.

DETAILED DESCRIPTION OF PREFERRED EMBODIMENTS

Figure 1:
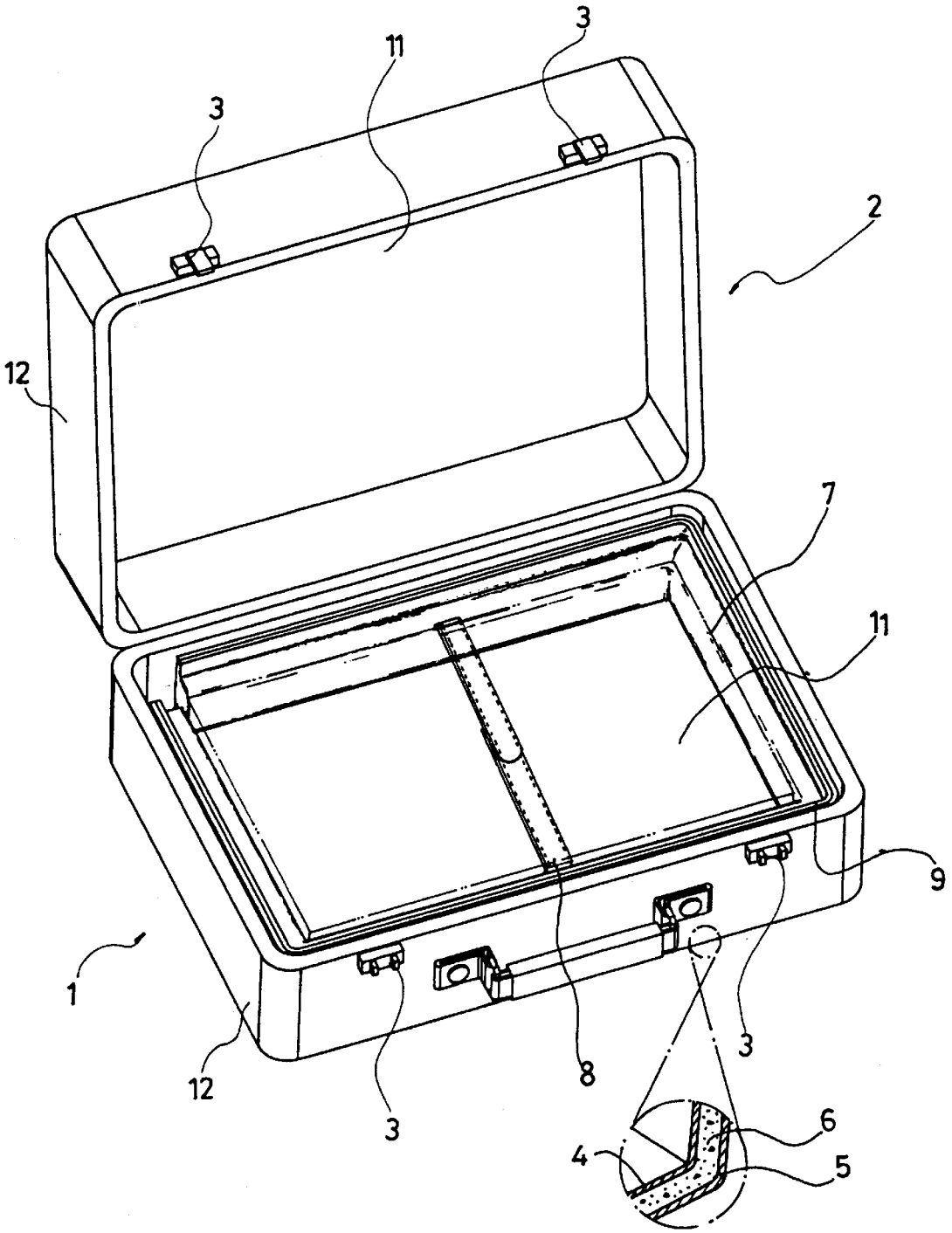
FIG. 1 (Prior Art)
FIG. 1 is a perspective view illustrating a briefcase having shock-absorbing function of the related art.
Figure 2:
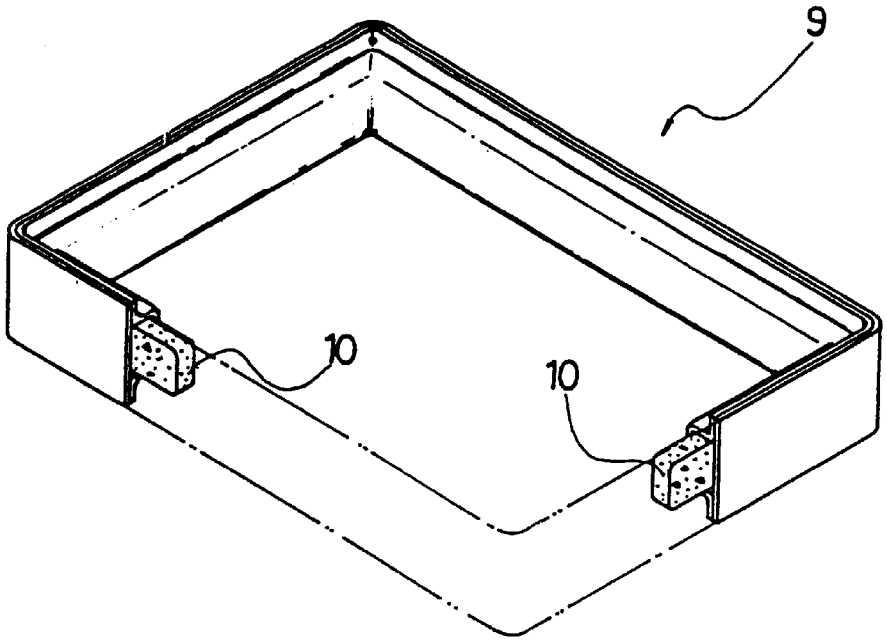
FIG. 2 (Prior Art)
FIG. 2 is a partially cut-away perspective view illustrating an independent appearance of a shock-absorbing air pad used in the briefcase of FIG. 1.

Reference will now be made in greater detail to preferred embodiments of the present invention, examples of which are illustrated in the accompanying drawings. Wherever possible, the same reference numerals will be used throughout the drawings to refer to the same or like parts.

Figure 3:
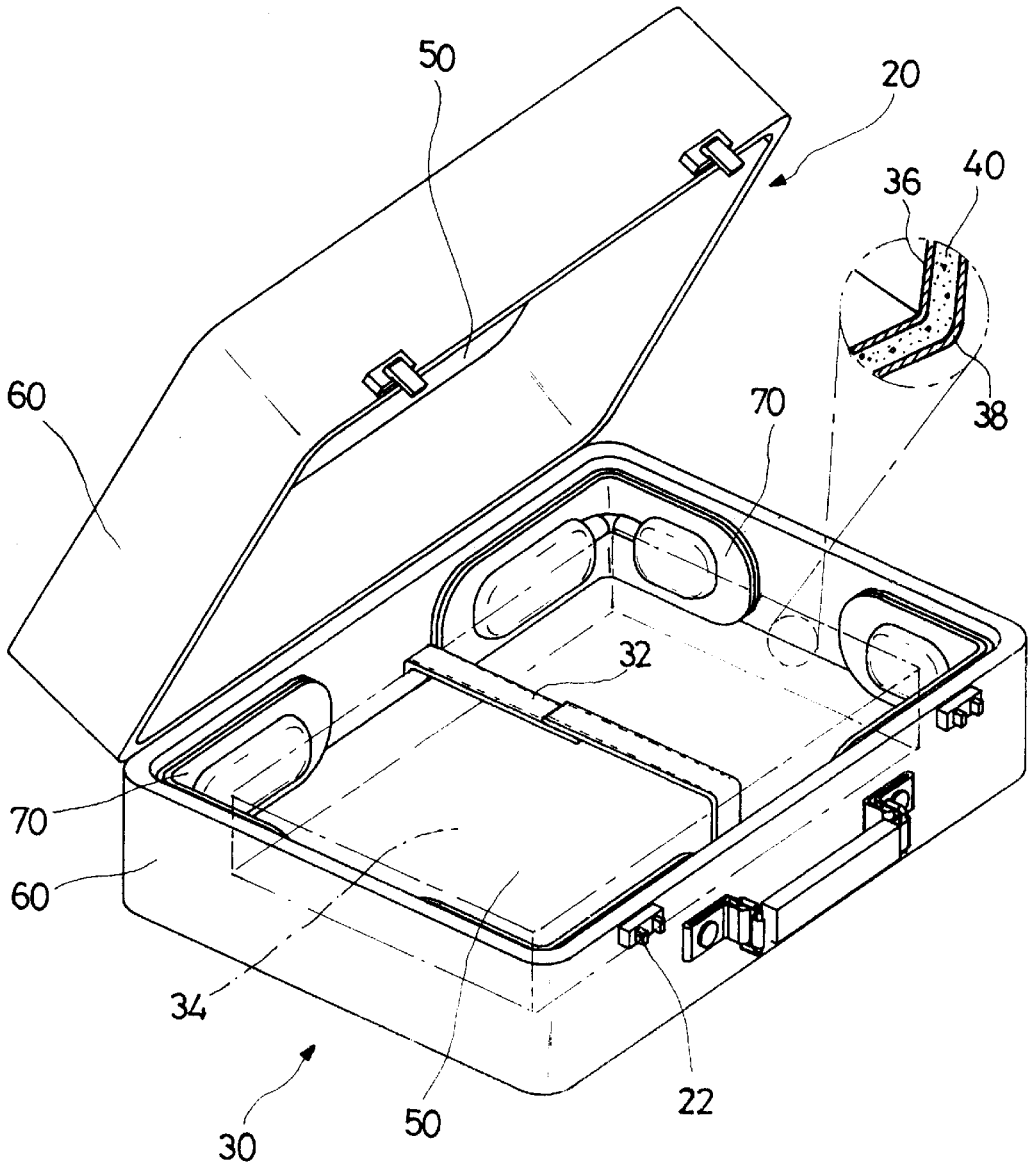
FIG. 3 is a perspective view illustrating a whole construction of a briefcase having shock-absorbing function in accordance with an embodiment of the present invention.
Figure 4:
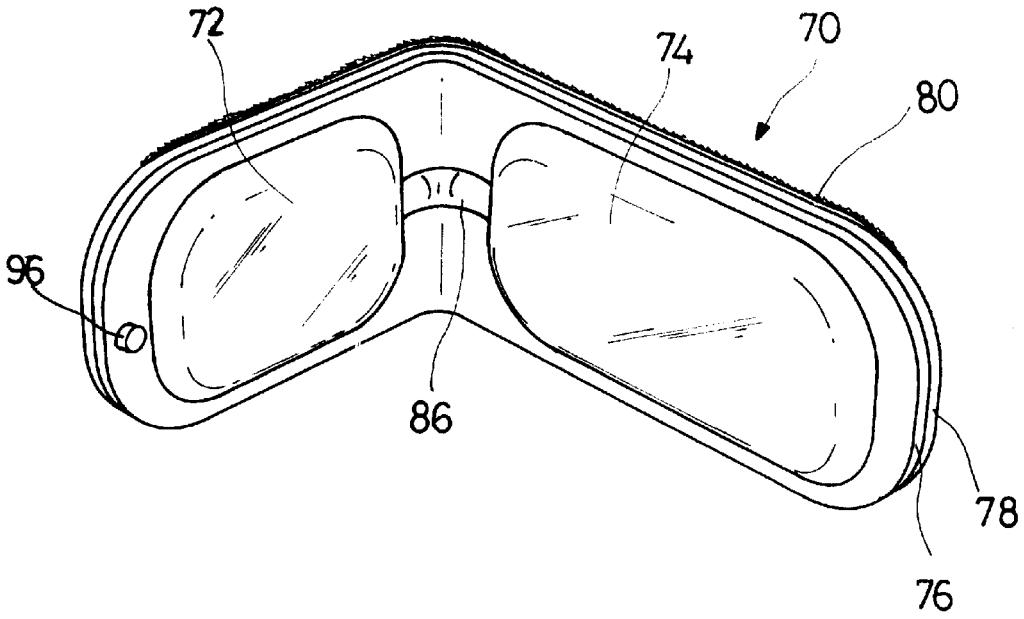
FIG. 4 is a perspective view illustrating an independent appearance of a shock-absorbing air pad used in the briefcase of FIG. 3.
Figure 5:
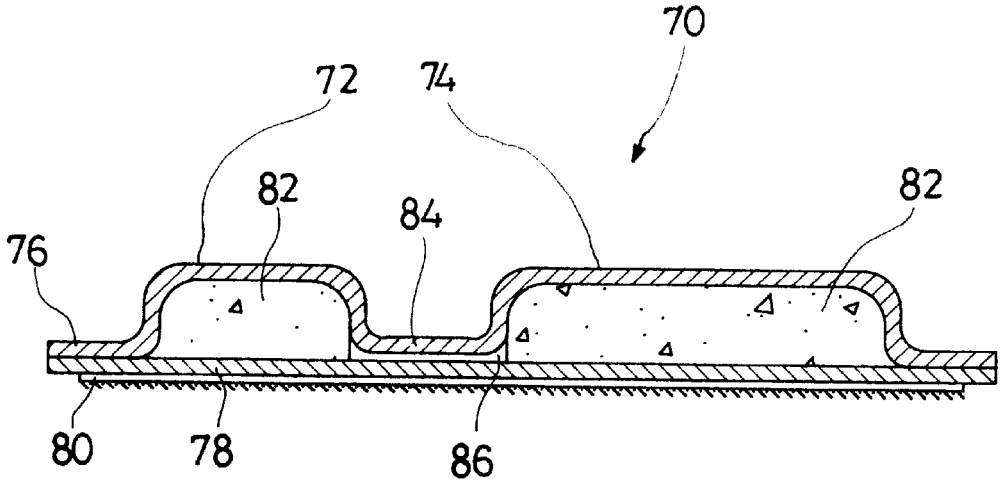
FIG. 5 is a transverse-sectional view of the shock-absorbing air pad of FIG. 4.
Figure 6:
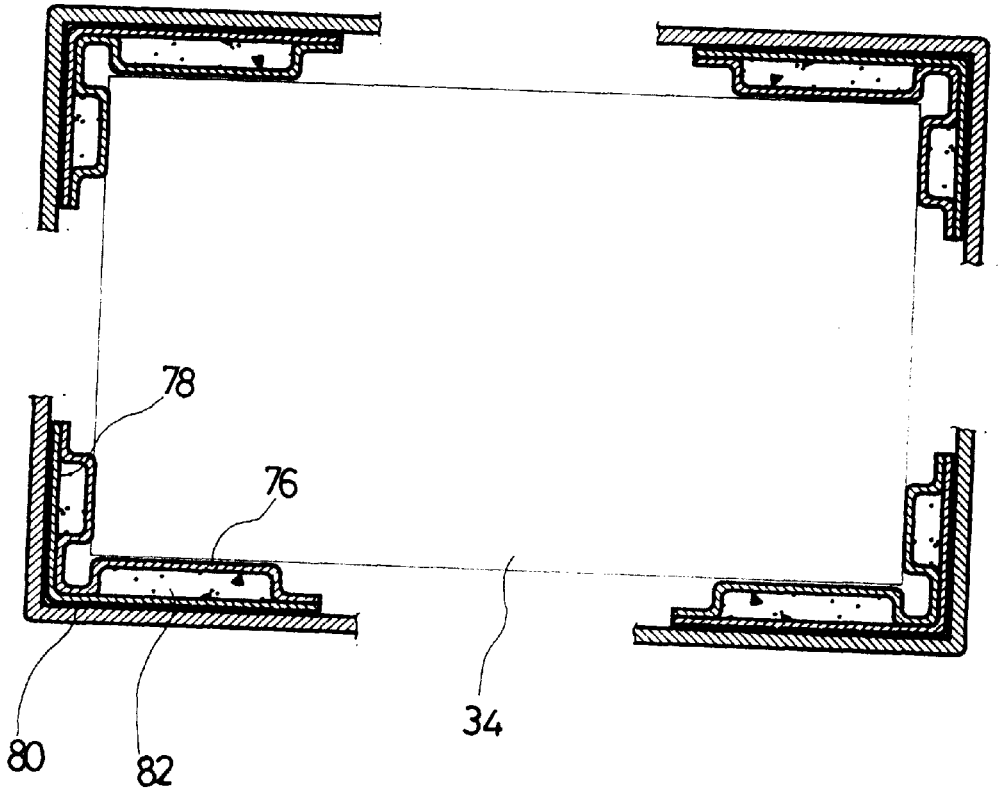
FIG. 6 is a transverse-sectional view illustrating a state in which the shock-absorbing air pad is mounted to the briefcase.

Referring to FIG. 3, there is illustrated a perspective view illustrating a whole construction of a briefcase having shock-absorbing function in accordance with an embodiment of the present invention. The briefcase having shock-absorbing function according to the present embodiment of the present invention includes a body 30 for receiving and holding an article 34, and a cover 20 pivotally connected to the body 30 for preventing the article 34 from being released. The body 30 and the cover 20 cooperate with each other to define an article receiving space. Two pairs of opening/closing means 22 such as latch/striker mechanism are provided to the body 30 and the cover 20, respectively. Each of the body 30 and the cover 20 has a bottom wall 50 which delimits lower and upper ends of the article receiving space and a side wall 60 which delimits front, rear, left and right ends of the article receiving space. Each of the bottom wall 50 and the side wall 60 includes an inner shell 36 and an outer shell 38 between which a foaming member 40 is intervened for allowing the briefcase to retain its desired rigidity. In a preferred embodiment of the present invention, the inner shell 36 and the outer shell 38 are made from a combination of cloth and urethane, and edges of the inner shell 36 and the outer shell 38 are fused to each other by an ultrasonic wave. At a center portion of the body 30, there is arranged an elastic band 32 for maintaining the article 34 such as notebook computer in position when the article 34 is received in the article receiving space.

The briefcase having shock-absorbing function of the present embodiment further includes four shock-absorbing air pads 70 each of which comprises an inner skin 76 and an outer skin 78. In a preferred embodiment of the present invention, the inner skin 76 and the outer skin 78 are made from urethane, and edges of the inner skin 76 and the outer skin 78 are fused to each other by an ultrasonic wave. A pair of foaming elements 82 are intervened between the inner skin 76 and the outer skin 78 of each shock-absorbing air pad 70, respectively, such that they are spaced apart by a distance. The pair of foaming elements 82 define a first shock-absorbing section 72 and a second shock-absorbing section 74 in the shock-absorbing air pad 70. Each foaming element 82 is bonded to the inner skin 76 and the outer skin 78 by an adhesive. The first shock-absorbing section 72 and the second shock-absorbing section 74 are filled with an air of a predetermined pressure, and the first shock-absorbing section 72 and the second shock-absorbing section 74 are connected to each other by a connection part 84 which is composed only of the inner skin 76 and the outer skin 78. An air passage 86 is defined in the connection part 84 for communicating the first shock-absorbing section 72 and the second shock-absorbing section 74 which are filled with the air. Due to the fact that the connection part 84 is composed only of the inner skin 76 and the outer skin 78, a middle portion of the shock-absorbing air pad 70 can be easily bent.

The four shock-absorbing air pads 70 constructed as mentioned above are arranged to four corner portions of the side wall 60 composing the body 30, respectively. The outer skin 78 of the shock-absorbing air pad 70 is attached to one surface of a magic fastener 80, and the other surface of the magic fastener 80 is attached to an inner surface of the side wall 60 of the body 30. Accordingly, the first shock-absorbing section 72 and the second shock-absorbing section 74 is positioned at both sides of one corner portion, and the connection part 84 is easily bent to extend across the corner portion. In a preferred embodiment of the present invention, the two foaming elements 82 respectively inserted into the first shock-absorbing section 72 and the second shock-absorbing section 74 have different lengths such that the shock-absorbing air pad 70 can be properly used to another briefcase having a different size.

Figure 7:
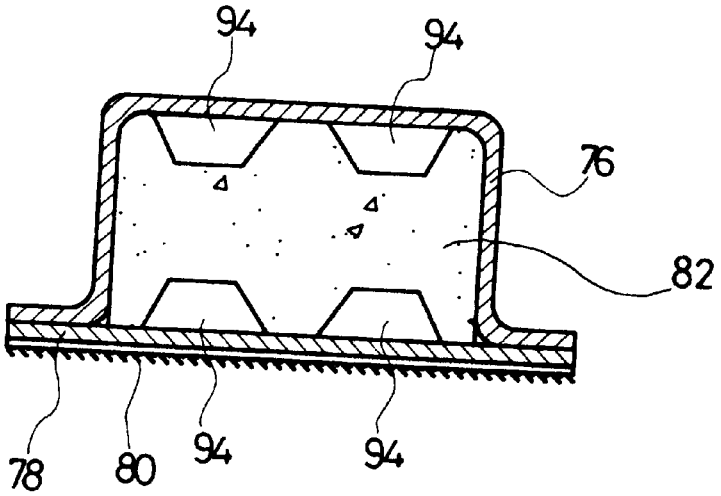
FIG. 7 is a transverse-sectional view showing a structure of a foaming element inserted into the shock-absorbing air pad.

Referring to FIG. 7, there is illustrated a transverse-sectional view showing a structure of a foaming element inserted into the shock-absorbing air pad. According to a preferred embodiment of the present invention, upper surfaces and lower surfaces of the foaming elements 82 respectively inserted into the first shock-absorbing section 72 and the second shock-absorbing section 74 of the shock-absorbing air pad 70 are formed with a plurality of grooves 94. The plurality of grooves 94 are spaced apart from each other and are filled with an air of a desired pressure. Therefore, an impact force applied to the shock-absorbing air pad 70 can be sequentially absorbed by the foaming elements 82 and the air filling the plurality of grooves 94.

Figure 8:
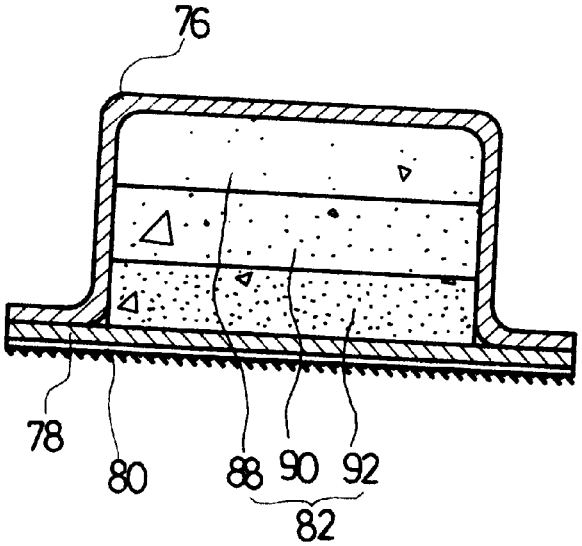
FIG. 8 is a transverse-sectional view showing another structure of the foaming element inserted into the shock-absorbing air pad.

Referring to FIG. 8, there is illustrated a transverse-sectional view showing another structure of the foaming element inserted into the shock-absorbing air pad. Each of the foaming elements 82 inserted into the first shock-absorbing section 72 and the second shock-absorbing section 74 of the shock-absorbing air pad 70 comprises a first foaming piece 88 having a ductility for primarily absorbing the impact force applied to the shock-absorbing air pad 70, a second foaming piece 90 stacked onto the first foaming piece 88 and having an elasticity larger than that of the first foaming piece 88 for secondarily absorbing a portion of the impact force not absorbed by the first foaming piece 88, and a third foaming piece 92 stacked onto the second foaming piece 90 and having another elasticity larger than that of the second foaming piece 90 for thirdly absorbing another portion of the impact force not absorbed by the second foaming piece 90. Hence, by the fact that the foaming element 82 is divided into several pieces, the foaming element 82 can effectively dissipate and absorb the impact force applied to the shock-absorbing air pad 70.

Accordingly, in a state that the four shock-absorbing air pads 70 are attached to four corner portions of the side wall 60 composing the body 30, respectively, the article 34 such as notebook computer can be received in the article receiving space. After the article 34 is received in the article receiving space, by coupling free ends of the elastic band 32 to each other and closing the cover 20, the article 34 can be safely held in the briefcase. The impact force applied to the shock-absorbing air pad 70 is sequentially absorbed by the foaming elements 82 divided into several pieces or formed with a plurality of grooves 94 and by the air filled into the first shock-absorbing section 72 and the second shock-absorbing section 74. Consequently, the impact force is hardly applied to the article 34.

Figure 9:
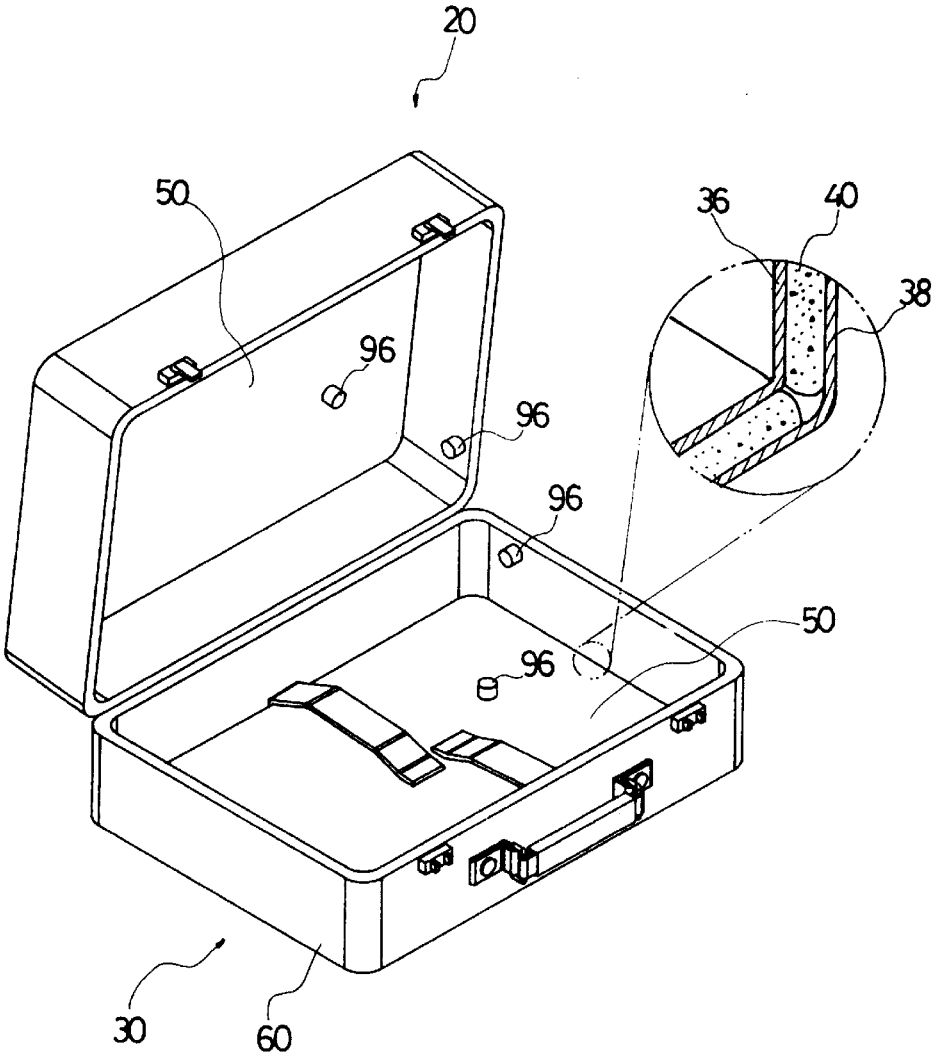
FIG. 9 is a perspective view illustrating a whole construction of a briefcase having shock-absorbing function in accordance with another embodiment of the present invention.

Referring to FIG. 9, there is illustrated a perspective view illustrating a whole construction of a briefcase having shock-absorbing function in accordance with another embodiment of the present invention. A briefcase having shock-absorbing function according to the present embodiment of the present invention includes a body 30 for receiving and holding an article, and a cover 20 pivotally connected to the body 30 for preventing the article from being released. The body 30 and the cover 20 cooperate with each other to define an article receiving space. Two pairs of opening/closing means such as latch/striker mechanism are provided to the body 30 and the cover 20, respectively. Each of the body 30 and the cover 20 has a bottom wall 50 which delimits lower and upper ends of the article receiving space and a side wall 60 which delimits front, rear, left and right ends of the article receiving space. Each of the bottom wall 50 and the side wall 60 includes an inner shell 36 and an outer shell 38 between which a foaming member 40 is intervened for allowing the briefcase to retain its desired rigidity. In a preferred embodiment of the present invention, the inner shell 36 and the outer shell 38 are made from a combination of cloth and urethane, and edges of the inner shell 36 and the outer shell 38 are fused to each other by an ultrasonic wave. At a center portion of the body 30, there is arranged an elastic band for maintaining the article such as notebook computer in position when the article is received in the article receiving space.

The briefcase having shock-absorbing function of the present embodiment further includes a plurality of air supplying means each of which comprises a pump (not shown) and a check valve 96. The plurality of air supplying means are disposed at the bottom wall 50 and the side wall 60 composing body 30 and the cover 20, respectively, and supply an air of a predetermined pressure into a space between the inner shell 36 and the outer shell 38, thereby to define air layers between the inner shell 36 and the outer shell 38 composing the bottom wall 50 and the side wall 60. Accordingly, by supplying the air into the air layers through the check valve 96 using the pump on demand, air pressures in the air layers can be adjusted as occasion calls.

In other words, by supplying the air into the bottom wall 50 and the side wall 60 through the check valve 96, air layers are formed in the bottom wall 50 and the side wall 60, whereby when an impact force is applied to the bottom wall 50 and the side wall 60 of the body 30 and the cover 20 composing the briefcase, the impact force is sequentially absorbed by the air layers and the foaming member 40 and is hardly applied to the article. Consequently, the briefcase having shock-absorbing function according to the present embodiment of the present invention can completely and effectively absorb the impact force even when the impact force is applied both to the side wall 60 and the bottom wall 50.

As a result, by a briefcase having shock-absorbing function according to the present invention, it is possible to sequentially absorb and/or alleviate an impact force applied from outside and to protect an article received in the briefcase from shock. Also, by the fact that a plurality of shock-absorbing air pads can be selectively and detachably mounted to the briefcase, the briefcase may selectively display its role of general receiving function for receiving and holding various articles such as documents, clothes, etc. or its role of shock-absorbing function for absorbing the impact force to protect the costly article such as notebook computer, whereby a functionality of the briefcase is maximized.

In the drawings and specification, there have been disclosed typical preferred embodiments of the invention and, although specific terms are employed, they are used in a generic and descriptive sense only and not for purposes of limitation, the scope of the invention being set forth in the following claims. For example, while it is explained in the above embodiments that the plurality of air supplying means are disposed to the bottom wall 50 and the side wall 60 composing the body 30 and the cover 20, it is to be understood that the air supplying means can be used to supply an air into a space between the inner skin 76 and the outer skin 78 composing the shock-absorbing air pad 70.

What is claimed is:

1. A briefcase for receiving an article comprising;

a body;

a cover, each said body and said cover having a bottom wall and a side wall; and a plurality of air pads, each said air pads being detachably attached to a corner portion of a side wall of the body and cover for absorbing an impact force applied to the side wall, each said air pad comprises an air-impermeable outer skin detachably attached to the side wall, an air-impermeable inner skin integrally coupled to the outer skin, a pair of foaming elements intervened between the outer skin and the inner skin so that the foaming elements are spaced apart by a distance thereby defining a first shock-absorbing section and a second shock-absorbing section at both sides of the corner portion, respectively, a connecting part defining an air passage to connect the first with the second shock-absorbing sections to allow the first and second shock-absorbing sections to communicate with each other.

2. A briefcase for receiving an article as claimed in claim 1, wherein the foaming element is bonded to the outer skin and the inner skin by an adhesive.

3. A briefcase for receiving an article as claimed in claim 1, wherein each foaming element comprises a first foaming piece having a ductility for primarily absorbing the impact force applied to the side wall, a second foaming piece stacked onto the first foaming piece and having a rigidity larger than that of the first foaming piece for secondarily absorbing a portion of the impact force not absorbed by the first foaming piece, and a third foaming piece stacked onto the second foaming piece and having another rigidity larger than that of the second foaming piece for thirdly absorbing another portion of the impact force not absorbed by the second foaming piece.

4. A briefcase for receiving an article as claimed in claim 1, wherein an upper surface and a lower surface of each foaming element are formed with a plurality of grooves, respectively, into which an air of a predetermined pressure is filled so that the impact force applied to the side wall is sequentially absorbed by the foaming element and the air filled into the plurality of grooves.

5. A briefcase for receiving an article as claimed in claim 1, wherein each of the bottom wall and the side wall comprises an outer shell and an inner shell, and wherein the briefcase further comprises first air supplying means for supplying air between the outer shell and the inner shell thereby defining a first air layer between the outer shell and the inner shell.

6. A briefcase for receiving an article as claimed in claim 1, further comprising: air supplying means for supplying air between the outer skin and the inner skin of the air pad thereby defining an air layer between the outer skin and the inner skin.

7. A briefcase for receiving an article as claimed in claim 5, wherein each of the first and second air supplying means comprises a pump and a check valve, whereby air pressures in the first and second air layers can be adjusted as occasion calls.

8. A briefcase for receiving an article as claimed in claim 2, wherein each foaming element comprises a first foaming piece having a ductility for primarily absorbing the impact force applied to the side wall, a second foaming piece stacked onto the first foaming piece and having a rigidity larger than that of the first foaming piece for secondarily absorbing a portion of the impact force not absorbed by the first foaming piece, and a third foaming piece stacked onto the second foaming piece and having another rigidity larger than that of the second foaming piece for thirdly absorbing another portion of the impact force not absorbed by the second foaming piece.

9. A briefcase for receiving an article as claimed in claim 6, wherein the air supplying means comprises a pump and a check valve, whereby air pressures in the first and second air layers can be adjusted.

10. A briefcase for receiving an article as claimed in claim 5, wherein the outer skin and the inner skin composing the air pad are made from urethane, and the outer shell and the inner shell composing the bottom wall and side wall are made from a combination of cloth and urethane.

11. A briefcase for receiving an article as claimed in claim 5, wherein edges of the outer skin and the inner skin composing the air pad, and edges of the outer shell and the inner shell composing the bottom wall and side wall are fused to each other, respectively, by an ultrasonic wave to prevent air from leaking.

* * * * *